US010952003B2

(12) United States Patent
Scuda

(10) Patent No.: US 10,952,003 B2
(45) Date of Patent: Mar. 16, 2021

(54) APPARATUS AND METHOD FOR PROVIDING A MEASURE OF SPATIALITY ASSOCIATED WITH AN AUDIO STREAM

(71) Applicant: Fraunhofer-Gesellschaft zur Förderung der angewandten Forschung e.V., München (DE)

(72) Inventor: Ulli Scuda, Eckental (DE)

(73) Assignee: FRAUNHOFER-GESELLSCHAFT ZUR FÖRDERUNG DER ANGEWANDTEN FORSCHUNG E.V., Munich (DE)

( * ) Notice: Subject to any disclaimer, the term of this patent is extended or adjusted under 35 U.S.C. 154(b) by 0 days.

(21) Appl. No.: 16/558,787

(22) Filed: Sep. 3, 2019

(65) Prior Publication Data

US 2020/0021934 A1 Jan. 16, 2020

Related U.S. Application Data

(63) Continuation of application No. PCT/EP2018/055482, filed on Mar. 6, 2018.

(30) Foreign Application Priority Data

Mar. 8, 2017 (EP) ..... 17159903

(51) Int. Cl.
*H04S 1/00* (2006.01)
*H04R 5/04* (2006.01)
*H04S 7/00* (2006.01)

(52) U.S. Cl.
CPC ..... *H04S 1/002* (2013.01); *H04R 5/04* (2013.01); *H04S 1/007* (2013.01); *H04S 7/40* (2013.01); *H04S 2420/01* (2013.01)

(58) Field of Classification Search
CPC . H04S 1/002; H04S 1/007; H04S 7/40; H04S 2420/01; H04R 5/04
See application file for complete search history.

(56) References Cited

U.S. PATENT DOCUMENTS 10,057,702 B2 8/2018 Geiger et al.
10,210,883 B2 2/2019 Geiger et al.
10,284,988 B2 5/2019 Kraft et al.
(Continued)

FOREIGN PATENT DOCUMENTS

CN 103444209 A 12/2013
JP 2011-250049 A 12/2011
(Continued)

OTHER PUBLICATIONS

EBU. EBU Tech 3344; "Practical guidelines for distribution systems in accordance with EBU R 128;" Oct. 2011; pp. 1-88.
(Continued)

*Primary Examiner* — Andrew L Sniezek
(74) *Attorney, Agent, or Firm* — McClure, Qualey & Rodack, LLP

(57) ABSTRACT

Apparatus for evaluating an audio stream, wherein the audio stream includes audio channels to be reproduced at at least two different spatial layers, wherein the two spatial layers are arranged in a manner distanced along a spatial axis. The apparatus is configured to evaluate the audio channels of the audio stream so as to provide a measure of spatiality associated with the audio stream.

24 Claims, 5 Drawing Sheets

(56) References Cited

U.S. PATENT DOCUMENTS

| | | | | |
|---|---|---|---|---|
| 2007/0041592 | A1 | 2/2007 | Avendano et al. | |
| 2013/0202116 | A1 | 8/2013 | Par | |
| 2016/0080886 | A1 | 3/2016 | De Bruijn et al. | |
| 2019/0191258 | A1* | 6/2019 | Lando | G10L 19/008 |
| 2020/0045495 | A9* | 2/2020 | Tsingos | H04S 7/308 |

FOREIGN PATENT DOCUMENTS

| | | | |
|---|---|---|---|
| WO | 2016091332 | A1 | 6/2016 |
| WO | 2016126907 | A1 | 8/2016 |
| WO | 2016156091 | A1 | 10/2016 |
| WO | 2016169608 | A1 | 10/2016 |

OTHER PUBLICATIONS

IRT. Technische Richtlinien—HDTV. Zur Herstellung von Fernsehproduktionen für ARD, ZDF und ORF. Frankfurt a.M., 2011; pp. 1-114.
English translation of RT. Technische Richtlinien—HDTV. Zur Herstellung von Fernsehproduktionen für ARD, ZDF und ORF. Frankfurt a.M., 2011; pp. 1-80.
ARTE. Allgemeine technische Richtlinien. ARTE, Kehl, 2013; pp. 1-108.
Spikofski, G., et al.; "Levelling and Loudness in Radio and Television Broadcasting;" European Broadcast Union, Geneva, 2004; pp. 1-12.
ITU. ITU-R BS.2054-2: Audio Levels and Loudness, vol. 2. International Telecommunication Union, Geneva, 2011; pp. 1-23.
Gareus, R., et al.; "Audio Signal Visualisation and Measurement; "In International Computer Music and Sound & Music Computing Conference, Athens, 2014; pp. 1-7.
Mendiburu, B.; "3D Movie Making—Stereoscopic Digital Cinema from Script to Screen;" Focal Press, 2009; pp. 1-232.
Mendiburu, B.; "3D TV and 3D Cinema. Tools and Processes for Creative Stereoscopy;" Focal Press, 2011; pp. 1-255.
Silzle, A.; "3D Audio Quality Evaluation: Theory and Practice;" In International Conference on Spatial Audio, Erlangen, 2014. VDT; pp. 129-138.
Zacharov, N., et al.; "Spatial sound attributes—development of a common lexicon;" In AES 139th Convention, New York, 2015. Audio Engineering Society; pp. 1-11.
Schoeffler, M., et al.; "The Influence of the Single / Multi-Channel-System on the Overall Listening Experience;" In AES 55th Conference, Helsinki, 2014; pp. 1-8.
Scuda, U.; "Comparison of Multichannel Surround Speaker Setups in 2D and 3D;" In Malte Kob, editor, International Conference on Spatial Audio, Erlangen, 2014. VDT; pp. 112-121.
Sazdov, R., et al.; "Perceptual Investigation into Envelopment, Spatial Clarity and Engulfment in Reproduced Multi-Channel Audio;" In AES 31st Conference, London, 2007. Audio Engineering Society; pp. 1-11.
Sazdov, R.; "The effect of elevated loudspeakers on the perception of engulfment, and the effect of horizontal loudspeakers on the perception of envelopment;" In ICSA 2011. VDT; pp. 1-6.
Sazdov, R.; "Envelopment vs. Engulfment: Multidimensional scaling on the effect of spectral content and spatial dimension within a three-dimensional loudspeaker setup;" In International Conference on Spatial Audio, Graz, 2015; pp. 1-15.
Pedersen, T.H., et al.; "The development of a Sound Wheel for Reproduced Sound;" In AES 138th Convention, Warsaw, 2015. AES; pp. 1-13.
1AES. Technical Document AESTD1005.1.16-09: Audio Guidelines for Over the Top Television and Video Streaming. AES, New York, 2016; pp. 1-6.
Lee, H.; "The Relationship between Interchannel Time and Level Differences in Vertical Sound Localisation and Masking;" In AES 131st Convention, No. lcld, pp. 1-13, 2011.
Stenzel, H., et al.; "Localization and Masking Thresholds of Diagonally Positioned Sound Sources and Their Relationship to Interchannel Time and Level Differences;" In International Conference on Spatial Audio, Erlangen, 2014. VDT; pp. 159-168.
Komiyama, S.; "Visual Monitoring of Multichannel Stereophonic Signals;" Journal of the Audio Engineering Society, New York, US, vol. 45, No. 11, 1997, pp. 944-498.
Cabot, R.C.; "Automated Assessment of Surround Sound;" AES Convention 127, Oct. 2009, pp. 1-8.
International Search Report/Written Opinion issued in application No. PCT/EP2018/055482.
Russian Office Action dated Apr. 17, 2020, issued in application No. 2019131467107.
Chinese Office Action dated Sep. 3, 2020, issued in application No. 201880030173.4.
English Translation of Chinese Office Action dated Sep. 3, 2020, issued in application No. 201880030173.4.
Japanese Office Action dated Sep. 23, 2020, issued in application No. 2019-548682.
English Translation of Japanese Office Action dated Sep. 23, 2020, issued in application No. 2019-548682.

* cited by examiner

APPARATUS AND METHOD FOR PROVIDING A MEASURE OF SPATIALITY ASSOCIATED WITH AN AUDIO STREAM

CROSS-REFERENCE TO RELATED APPLICATIONS

This application is a continuation of copending International Application No. PCT/EP2018/055482, filed Mar. 6, 2018, which is incorporated herein by reference in its entirety, and additionally claims priority from European Application No. 17159903.8, filed Mar. 8, 2017, which is also incorporated herein by reference in its entirety.

Embodiments of the present invention relate to evaluating a spatial characteristic associated with an audio stream, namely a measure of spatiality.

BACKGROUND OF THE INVENTION

Evaluating 3D-audio content with focus on its 3D-ness is tedious work which involves a specific listening room and an experienced audio engineer who listens to all the content.

When working with audio on a professional level, every production stage is specific and needs experts in that specific field. One receives content from earlier production stages to edit it. Finally, it is passed on to the following production or distribution stage. When receiving content, usually a quality check is carried out to ensure that the material is good to work with and fulfills the given standards. For example, broadcast stations perform a check on all incoming material to see if the overall level or the dynamic range is within the desired range [1, 2, 3]. Therefore, there exists a desire to automate the described processes as much as possible to reduce the resources needed.

When dealing with 3D-audio, new aspects add up to the existing situation. Not only that, there are more channels to oversee for loudness evaluation and downmix possibilities, but also the question of at what time positions 3D effects occur and how strong they are. The latter is of interest for the following reason. Up to now, 5.1 has been the standard sound format for movies and feature films in the home market. All workflows and segments of the production and distribution chain (e.g., mixing, mastering facility, streaming platform, broadcasters, AN receivers, . . . ) are capable of passing through 5.1 sound, which is not the case for 3D-audio, because this reproduction method has arisen in the past five years. Content producers are picking up producing for that format right now.

If 3D-audio content is involved, more resources have to be provided at all points of the production chain compared to legacy content. At most, sound editing studios, mixing studios and mastering studios are significant cost factors because their working environments need considerable upgrade by building bigger rooms with better room acoustics, more speakers and extended signal flows to be able to work on 3D-audio content. That is why careful decisions are made, as to which production will get higher budgets and extra work to be brought to the customer in 3D-audio.

Up until now, evaluating 3D-audio content and making a statement about how impressive 3D-audio effects are, was only be done by listening to it. This is usually done by an experienced sound engineer or tonmeister and takes at least the time of the whole program, if not longer. Because of high extra costs for 3D-audio listening facilities, listening and evaluating needs to be efficient.

A common method for analyzing multi-channel audio signals is level and loudness monitoring [4, 5, 6]. A level of a signal is measured using a peak meter or a true peak meter with overload indicator. A measure that is closer to the human perception is loudness. Integrated loudness (BS.1770-3), loudness range (EBU R 128 LRA), loudness after ATSC A/85 (Calm Act), short-term and momentary loudness, loudness variance or loudness history are the most often-used loudness measures. All these measures are well used for stereo and 5.1 signals. Loudness for 3D-audio is currently under investigation by ITU.

To compare the phase relation of two (stereo) or five (5.1) signals, goniometer, vectorscope and correlation meters are available. The spectral distribution of energy can be analyzed using a real time analyzer (RTA) or a spectrograph. There also is a surround sound analyzer available to measure the balance within a 5.1 signal.

A method to visualize a 3D effect for a stereoscopic video over time is the depth script, depth chart or depth plot [7, 8].

All these methods have two things in common. They fail to analyze 3D-audio because they have been developed for stereo and 5.1 signals. And they are not able to give information about the 3D-ness of a 3D-audio signal.

Therefore, there exists a desire for an improved concept to acquire a measure of spatiality for audio streams.

SUMMARY

An embodiment may have an apparatus for evaluating an audio stream, wherein the audio stream includes audio channels to be reproduced at at least two different spatial layers, wherein the two spatial layers are arranged in a manner distanced along a spatial axis, wherein the apparatus is configured to evaluate the audio channels of the audio stream as to provide a measure of spatiality associated with the audio stream.

According to another embodiment, a method for evaluating an audio stream may have the steps of: evaluating audio channels of the audio stream as to provide a measure of spatiality associated with the audio stream; wherein the audio stream includes audio channels to be reproduced at at least two different spatial layers, wherein the two spatial layers are arranged in a manner distanced along a spatial axis.

Another embodiment may have a non-transitory digital storage medium having a computer program stored thereon to perform the method for evaluating an audio stream, the method having the steps of: evaluating audio channels of the audio stream as to provide a measure of spatiality associated with the audio stream; wherein the audio stream includes audio channels to be reproduced at at least two different spatial layers, wherein the two spatial layers are arranged in a manner distanced along a spatial axis, when said computer program is run by a computer.

Embodiments of the invention provide an apparatus for evaluating an audio stream, wherein the audio stream comprises audio channels to be reproduced at at least two different spatial layers. The two spatial layers are arranged in a manner distanced along a spatial axis. The apparatus is further configured to evaluate the audio channels of the audio stream so as to provide a measure of spatiality associated with the audio stream.

The described embodiment seeks to provide a concept for evaluating the spatiality associated with an audio stream, i.e. a measure for a spatiality of the audio scene described by audio channels comprised by the audio stream. Such a concept renders the evaluation more time and cost effective than an evaluation by a sound engineer. In particular, evaluating audio streams comprising audio channels which may be assigned to loudspeakers at different spatial layers involves expensive listening room equipment when evaluating the audio stream manually. The audio channels of the audio streams may be assigned to loudspeakers arranged in spatial layers, wherein the spatial layers may be formed by loudspeakers being arranged in front and/or in the back of a listener, i.e. they may be frontal and/or rear layer, and/or the spatial layers may also be horizontal layers such as one in which a listener's head is located and/or one arranged higher or lower than a listener's head, which are all typical setups for 3D-audio. Therefore, the concept offers the advantage of evaluating said audio streams without having the need for a reproduction setup. Moreover, time can be saved which a sound engineer would have to invest to evaluate an audio stream by listening to it. The described embodiment may, for example, provide the sound engineer or another person skilled in the art, with an indication as to which time intervals are of special interest of the audio stream. Thereby, the sound engineer may only need to listen to these indicated time intervals of the audio stream to validate an evaluation result of the apparatus, leading to a significant reduction in labor cost.

In some embodiments, the spatial axis is oriented horizontally or the spatial axis is oriented vertically. When having the spatial axis oriented horizontally, a first layer may be located in front of a listener and a second layer, may be located at the back of a listener. For a vertically oriented spatial axis, a first layer may be located above the listener and a second layer may be on the same layer as the listener or beneath the listener.

In some embodiments, the apparatus is configured to obtain a first level information based on a first set of audio channels of the audio stream, and to obtain a second level information based on a second set of audio channels of the audio stream. Further, the apparatus is configured to determine a spatial level of information based on the first level of information and the second level of information and to determine the level of spatiality based on the spatial level information. For grouping, channels which are to be reproduced at loudspeakers close to each other may be used to form a group. Furthermore, for evaluating spatiality or obtaining the spatial level information, groups are used which are assigned to loudspeakers, wherein the loudspeakers from one group are located distanced from loudspeakers of another group. Thereby, when a sound is perhaps only reproduced on one side of a listener, e.g., from a group of loudspeakers above the listener, and no sound or only a sound with a small volume is reproduced from another side, e.g., from a group of loudspeakers beneath the listener, a strong spatial effect may be observed and determined. In some embodiments, the first set of audio channels of the audio stream is disjoint to the second set of audio channels of the audio stream. Using disjoint sets allows for a determination of a more meaningful spatial level information, when, for example, using channels of loudspeakers which are arranged opposingly. As disjoint sets are advantageously reproduced at loudspeakers which are oriented in differing directions from the listener an improved measure of spatiality may be obtained based on the spatial level information obtained therefrom.

In some embodiments, the first set of the audio channels of the audio stream is to be reproduced on loudspeakers in one or more first spatial layers and the second set of the audio channels of the audio stream is to be reproduced on loudspeakers on one or more second spatial layers. The one or more first layers and the one or more second layers are spatially distanced, e.g., such that they are disjoint sets. Using, for example, a first layer above and a second layer below a listener, a special layer of information may be derived when a sound source is more prominent from top speakers and the loudspeakers at the bottom or at the middle layer provide an ambient or background sound which has a lower level.

In some embodiments, the apparatus is configured to determine a masking threshold based on a level information of the first set of audio channels and to compare the masking threshold to a level information of the second set of audio channels. Further, the apparatus is configured to increase a spatial level information when the comparison indicates that the masking threshold is exceeded by the level information of the second set of audio channels. A level information may be a sound level which may be obtained by an instantaneous or averaged estimate of a sound level of an audio channel. The level information may, for example, also describe an energy which could be estimated by squared values (e.g., averaged) of a signal of an audio channel. Alternatively, the level information may also be obtained using absolute values or maximum values of a time frame of an audio signal. The described embodiment, may, for example, use a psychoacoustic perception threshold to define the masking threshold. Based on the masking threshold, a decision can be made, as to whether a signal or a sound source is perceived coming only from a set of audio channels, e.g., the second set of audio channels.

In some embodiments, the apparatus is configured to determine a similarity measure between a first set of audio channels of the audio stream to be reproduced at one or more first spatial layers and a second set of audio channels of the audio stream to be reproduced at one or more second spatial layers. Further, the apparatus is configured to determine the measure of spatiality based on the similarity measure. When signal components to be reproduced at the first set of audio channels are uncorrelated to signal components to be reproduced at the second set of audio channels, it can be assumed that two different audio objects are played back in each set of audio channels, wherein the channels are assigned to different loudspeakers. In other words, uncorrelated signals indicate non-similar audio content to be played back at different channels. Thereby, a strong spatial impression may be delivered to a listener as different objects may be perceived from varying sets of channels. Moreover, a cross correlation may be obtained using individual signals from group of channels or by cross correlating sum signals. The sum signals may be obtained by summing up individual signals of a group of channels or pairs of channels. Thus, an evaluation of similarity may be based on average cross correlation between groups of channels or pairs of channels.

In some embodiments, the apparatus is configured to determine the measure of spatiality such that the lower the similarity measure, the larger the measure of spatiality. Using the described simple relation (e.g., inverse proportionality) between the similarity measure and the measure of spatiality allows for a simple determination of the measure of spatiality based on the similarity measure.

In some embodiments, the apparatus is configured to determine a masking threshold based on a level information of the first set of audio channels and to compare the masking threshold to a level information of the second set of audio channels. Further, the apparatus is configured to increase the measure of spatiality when the comparison indicates that the masking threshold is exceeded (e.g. only slightly exceeded) by the level information of the second set of audio channels and a similarity measure indicates a low similarity between the first set of audio channels and the second set of audio channels. Using the spatial level information and the similarity measure in combination allows for a more precise and reliable determination of the measure of spatiality. Moreover, when one indicator (e.g., the spatial level information or the similarity measure) indicates a neutral spatiality the other indicator may be used to veer towards deciding for high or low spatiality of the audio stream.

In some embodiments, the apparatus is configured to analyze the audio channels of the audio stream with respect to a temporal variation of a panning of a sound source onto the audio channels. Analyzing the audio channels with respect to a change of the panning allows for simple tracking of audio objects over the audio channels. Moving audio objects among the audio channels over time produce an increased perceived spatial impression and, therefore, analyzing said panning is useful for a meaningful measure of spatiality.

In some embodiments, the apparatus is configured to obtain an upmix origin estimate based on a similarity measure between a first set of audio channels of the audio stream and a second set of audio channels of the audio stream. Further, the apparatus is configured to determine the measure of spatiality based on the upmix origin estimate. An upmix origin estimate may indicate if an audio stream is obtained from an audio stream which has fewer audio channels (e.g., upmixing stereo to 5.1 or 7.1, or an audio stream for 22.2 based on a 5.1 audio stream). Therefore, when an audio stream is based on an upmix, signal components of the audio channels will have a higher similarity as they are, generally, derived from a lower number of source signals. Alternatively, an upmix may be detected when, e.g., it is detected that in a first layer primarily a direct sound of a sound source is reproduced (e.g, without or little reverberation) and in a second layer a diffuse component of the sound source is reproduced (e.g., late reverberation). An audio stream which is based on an upmix has an influence on a quality of a spatial impression and, therefore, is useful for determining the measure of spatiality.

In some embodiments the apparatus is configured to decrease the measure of spatiality based on the upmix origin estimate, when the upmix origin estimate indicates that the audio channels of the audio stream are derived from an audio stream with fewer audio channels. Generally, an audio stream obtained from an audio stream with fewer audio channels will be perceived as having less quality in terms of spatial impression. Therefore, it is suitable to decrease the measure of spatiality if it is detected that the audio stream is based on an audio stream with fewer channels.

In some embodiments, the apparatus is configured to output the measure of spatiality accompanied by the upmix origin estimate. Separately outputting the upmix origin estimate may be useful as a sound engineer may use it as an important side information. The sound engineer may use the upmix origin estimate as a significant information for, e.g., assessment of the spatiality of the audio stream.

In some embodiments, the apparatus is configured to provide the measure of spatiality based on a weighting of at least two of the following parameters: a spatial level information of the audio stream, and/or a similarity measure of the audio stream, and/or a panning information of the audio stream and/or an upmix origin estimate of the audio stream. The described apparatus can beneficially weight the individual factors according to importance to obtain the measure of spatiality. The measure of spatiality obtained from this weighting may be improved, i.e., more meaningful, than a measure of spatiality obtained only from one of the described indicators.

In some embodiments, the apparatus is configured to visually output the measure of spatiality. Using a visual output, a sound engineer may decide about the spatiality of the audio stream based on visual inspection of the visual output.

In some embodiments the apparatus is configured to provide the measure of spatiality as a graph, wherein the graph is configured to provide information of the measure of spatiality over time. The time axis of the graph is aligned to a time axis of the audio stream. Providing information about the measure of spatiality over time can be helpful for sound engineers, as a sound engineer may inspect (e.g. listen to) sections of the audio stream which are indicated by the graph of the measure of spatiality, to contain spatially impressive content. Thereby, the sound engineer can extract spatially impressive audio scene fast from the audio stream or verify a determined measure of spatiality.

In some embodiments, the apparatus is configured to provide the measure of spatiality as a numerical value, wherein the numerical value represents the entire audio stream. A simple numerical value can, for example, be used for fast classification and ranking of different audio streams.

In some embodiments, the apparatus is configured to write the measure of spatiality into a log file. Using log files may especially be beneficial for automated evaluation.

Embodiments of the invention provide for a method for evaluating an audio stream. The method comprises evaluating audio channels of the audio stream so as to provide a measure of spatiality associated with the audio stream. Further, the audio stream comprises audio channels to be reproduced at at least two different spatial layers, wherein the two spatial layers are arranged in a manner distanced along a spatial axis.

BRIEF DESCRIPTION OF THE DRAWINGS

Embodiments of the present invention will be detailed subsequently referring to the appended drawings, in which.

DETAILED DESCRIPTION OF THE INVENTION

Figure 1:
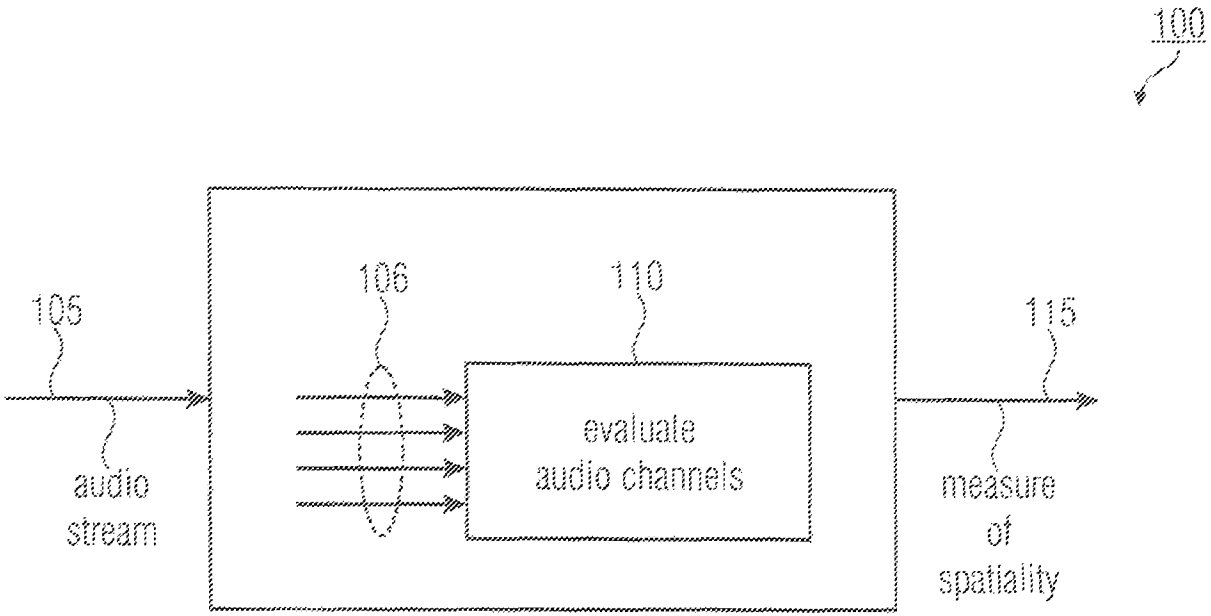
FIG. 1 shows a block diagram of an apparatus according to embodiments of the invention.

FIG. 1 shows a block diagram of an apparatus 100 according to embodiments of the invention. The apparatus 100 comprises an evaluator 110.

The apparatus 100 takes as input an audio stream 105 based on which audio channels 106 are provided to the evaluator 110. The evaluator 110 evaluates the audio channels 106 and based upon the evaluation the apparatus 100 provides a measure of spatiality 115.

The measure of spatiality 115 describes a subjective spatial impression of the audio stream 105. Conventionally, a person, advantageously a sound engineer, would have to listen to the audio stream to provide a measure of spatiality associated with the audio stream. Thereby, the apparatus 100 advantageously avoids the need for a skilled person to listen to the audio stream for evaluation. Moreover, for reliability a sound engineer may only listen to specific parts of the audio stream for verification which may have been indicated to have a high measure of spatiality by the apparatus 100. Thereby, time can be saved as the audio engineer may only need to listen to the indicated sections or time intervals. For example, the measure of spatiality 115 may be used by a sound engineer to inspect only time intervals or sections of the audio stream which are indicated by the measure of spatiality 115 as having an impressive 3D-audio effect, i.e., are subjectively spatially impressive. Based on this indication a sound engineer or a skilled listener may only be needed to listen to the specified sections to find or verify suitable sections of the audio stream. Moreover, the apparatus 100 may avoid the acquisition of expensive equipment or reduce usage time of expensive equipment. For example, a (e.g. expensive) sound lab which would be a needed playback environment to listen to the audio channels 106 may be used only for verification of the obtained measure of spatiality. Thereby, a sound lab can be used more efficiently or may even not be needed when the evaluation is entirely based on apparatus 100.

Figure 2:
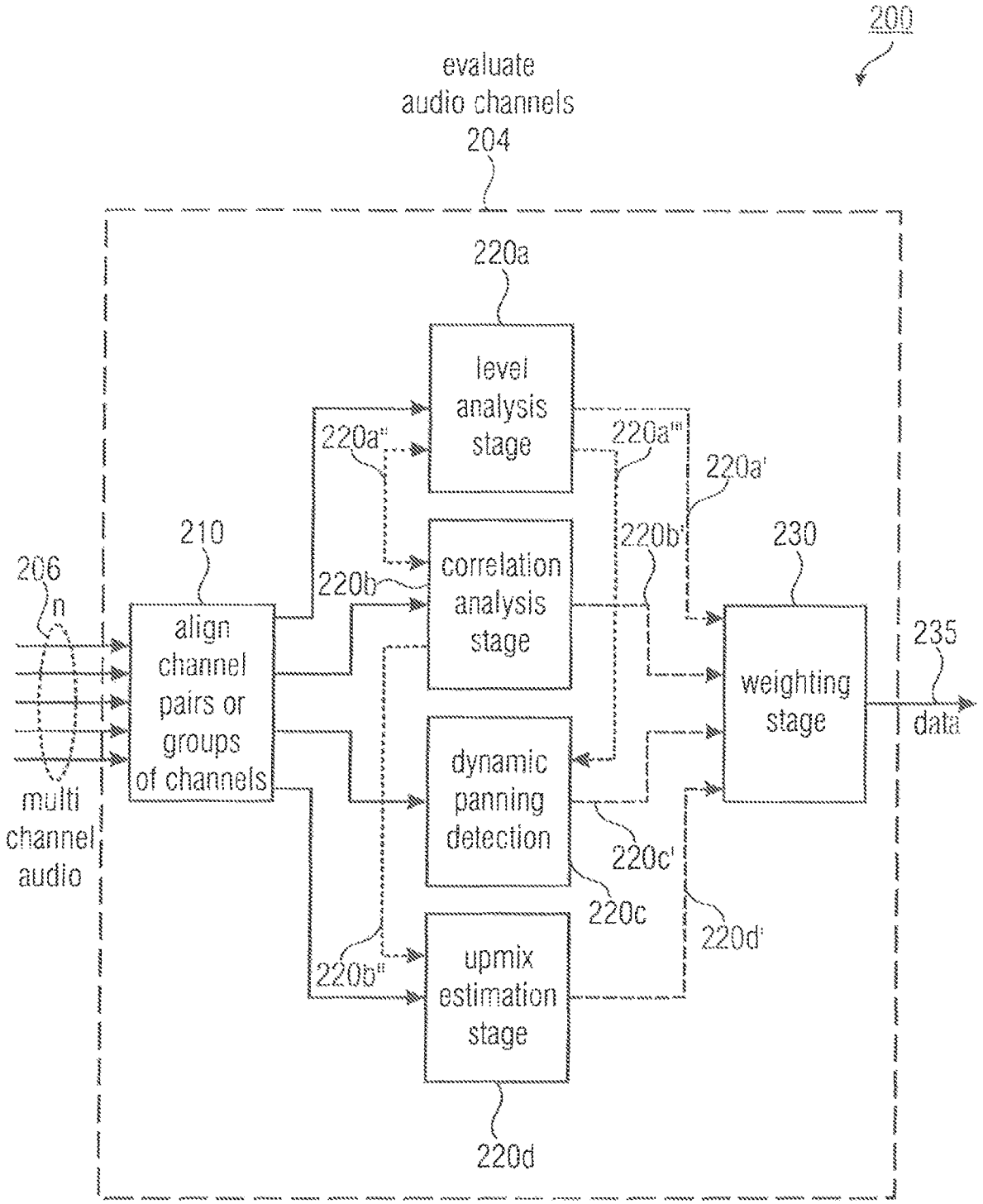
FIG. 2 shows a block diagram of an apparatus according to embodiments of the invention.

FIG. 2 shows a block diagram of an apparatus 200 according to embodiments of the invention. In other words, FIG. 2 can be interpreted as a signal flow with different stages (e.g., analysis stages). Solid lines indicate audio signals; (bold) dotted lines represent values used for estimating a 3D-Ness (e.g., measure of spatiality) and small (or thin) dotted lines may indicate an exchange of information between the different stages. The apparatus 200 comprises features and functionalities which may be included either individually or in combination into apparatus 100. The apparatus 200 comprises an optional signal or channel aligner/grouper 210, an optional level analyzer 220*a*, an optional correlation analyzer 220*b*, an optional dynamic panning analyzer 220*c* and an optional upmix estimator 220*d*. Further, the apparatus 200 comprises an optional weighter 230. The individual components 210, 220*a-d* and 230 may be individually or in combination comprised in the evaluator 110 and the audio channels 206 may be obtained from audio stream 105, similar to audio channels 106.

Figure 4:
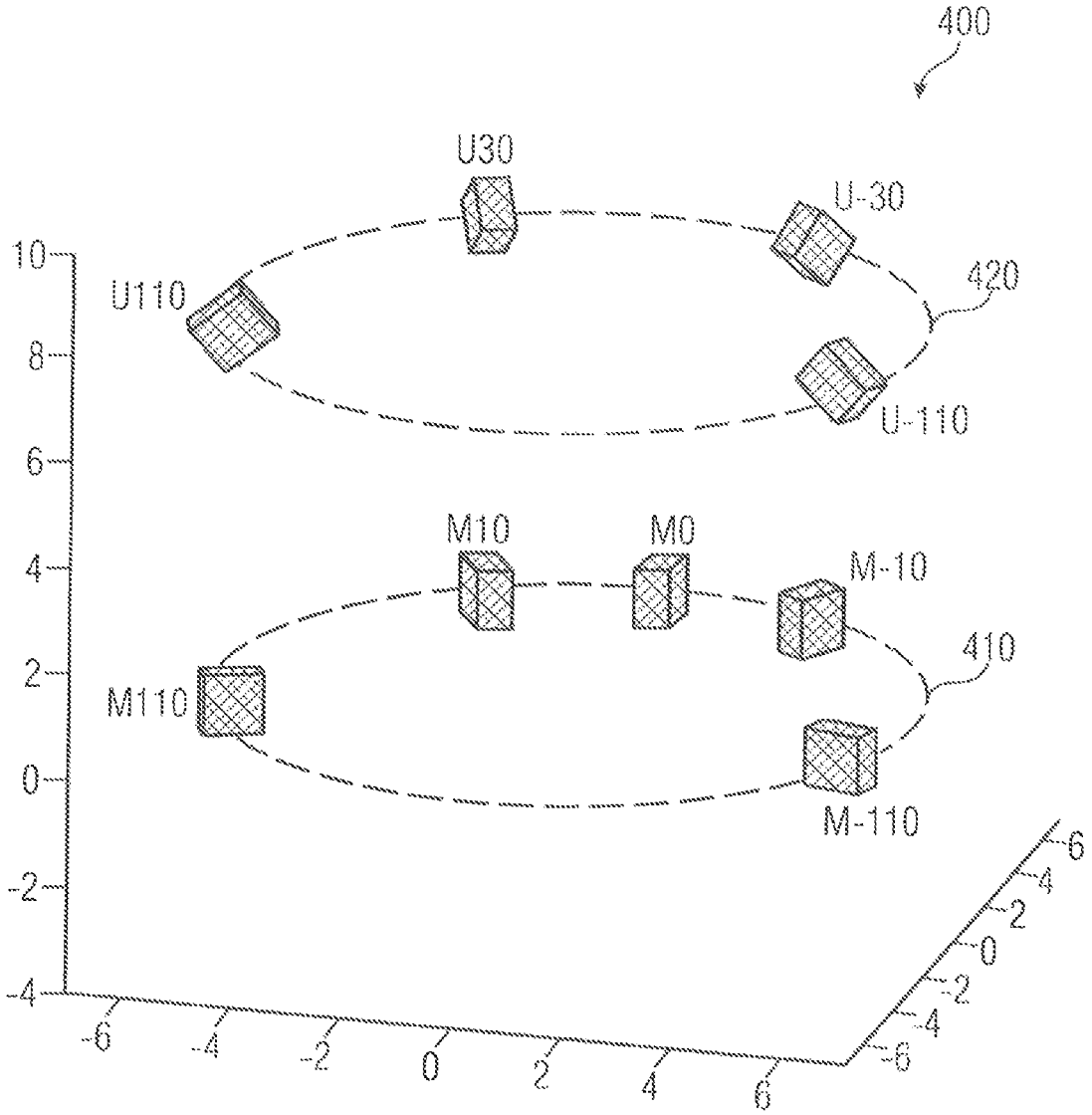
FIG. 4 shows a 3D-audio loudspeaker set up.

The apparatus 200 takes as input an audio signal of a multi-channel audio signal 206, based on which it provides a measure of spatiality 235 as output. The apparatus 200 comprises an evaluator 204 according to evaluator 110 which will be described in more detail in the following. In the aligner/grouper 210, signals or channels are aligned (e.g., in time) and grouped to channels which may, for example, be reproduced at different spatial layers (e.g. spatially grouped). Thereby, pairs or groups are obtained which are then provided to the analysis and estimation stages 220*a-d*. The grouping may be different for stage 220*a-d* and details in this regard are set out below. For example, groups may be based on layers as depicted in FIG. 4 where a loudspeaker setup with two layers is shown. A first group may be based on audio channels associated to layer 410 and a second group may be based on audio channels associated to layer 420. Alternatively, a first group may be based on channels assigned to loudspeakers on the left and a second group may be based on channels assigned to loudspeakers to the right. Further possible groupings are set out in more detail below.

In the level analysis stage 220*a*, a sound level of different groups is compared, wherein a group may consist of one or more channels. A sound level may, for example, be estimated based on a spontaneous signal value, an averaged signal value, a maximum signal value or an energy value of a signal. The average value, maximum value or energy value may be obtained from time frames of audio signals of the channels 206 or may be obtained using recursive estimation. If a first group is determined to have a higher level (e.g. average level or maximum level) than a second group, wherein the first group is spatially disjoint from the second group, a spatial level information 220*a*' is obtained indicating a high spatiality of the audio channels 206. This spatial level information 220*a*' is then provided to the weighting stage 230. The spatial level information 220*a*' contributes to computation of a final spatiality measure as outlined in the details below. Moreover, the level analysis stage 220*a* may determine a masking threshold based on a first group of audio channels, and obtain a high spatial level information 220*a*' when a second group of channels has a level higher than the determined masking threshold.

Further, groups or pairs of channels as output by grouper/aligner 210, are provided to the correlation analysis stage 220*b* which may compute correlations (e.g., cross correlations) between individual signals, i.e. signals of channels, of different groups or pairs to assess similarity. Alternatively, the correlation analysis stage may determine a cross correlation between sum signals. The sum signals may be obtained from different groups by adding up the individual signals in each group, thereby, an average cross correlation between groups may be obtained, characterizing an average similarity among groups. If the correlation analysis stage 220*b* determines a high similarity between the groups or pairs, a similarity value 220*b*' is provided to the weighting stage 230 indicating a low spatiality of the audio channels 206. Correlation may be estimated in the correlation analysis stage 220*b* on a per-sample basis or by correlating time frames of signals of the channels, groups of channels or pairs of channels. Furthermore, the correlation analysis stage 220*b* may use a level information 220*a*" to perform a correlation analysis based on information provided by the level analysis stage 220*a*. For example, signal envelopes of different channels, groups of channels or pairs of channels, obtained from the level analysis stage 220*a*, may be comprised in the level information 220*a*". Based on the envelopes a correlation may be performed to obtain information about similarity between individual channels, groups of channels or pairs of channels. Further, the correlation analysis stage 220*b* may use the same channel grouping as provided to the level analysis stage 220*a* or may use an entirely different grouping.

Moreover, the apparatus 200 can perform a dynamic panning analysis/detection 220*c* based on the pairs or groups. The dynamic panning detection 220*c* may detect sound objects moving from one pair or group of channels to another pair or group of channels, e.g. a level evolution from a first group of channels to a second group of channels. Having sound objects moving across different pairs or groups, provides for a high spatial impression. Therefore, a dynamic panning information 220*c*' is provided to the weighting stage 230 indicating a high spatiality if moving sources are detected by the panning analysis stage 220*c*. Further, the dynamic panning information 220*c*' may indicate a low spatiality if no movement (or only small movements, e.g. inside a group of channels only) of sound sources among pairs or groups of channels is detected. The panning detection stage 220*c* may perform panning analysis in a sample-wise or in a frame-by-frame manner. Moreover, the dynamic panning detection stage 220*c* may use level information 220*a*'" obtained from the level analysis stage 220*a*, to detect a panning. Alternatively, the panning detection stage 220*d* may estimate level information on its own for performing panning detection. The dynamic panning detection 220*c* may use the same groups as the level analysis stages 220*a* or the correlation analysis stage 220*b* or different groups provided by grouper/aligner 210.

Furthermore, the upmix estimation stage 220*d* may use correlation information 220*b*" from the correlation analysis stage 220*b* or perform further correlation analysis to detect, whether the channels 206 were formed using an audio stream with fewer audio channels. For example, the upmix estimation stage 220*d* may assess whether the channels 206 are based on an upmix directly from the correlation information 220*b*". Alternatively, cross correlation between individual channels may be performed in the upmix estimation stage 220*d*, e.g. based on a high correlation indicated by correlation information 220*b*", to assess whether the channels 206 originate from an upmix. The correlation analysis either performed by correlation analysis stage 220*b* or by the upmix estimate stage 220*c*, is a useful information for upmix origin detection as a common way to produce an upmix is by means of signal decorrelators. The upmix origin estimate 220*d*' is provided by the upmix estimation stage 220*d* to the weighting stage 230. If the upmix origin estimate 220*d*' indicates that the channels 206 are derived from an audio stream with fewer channels, the upmix origin estimate 220*d*' may provide a negative or small contribution to the weighter 235. The upmix estimation stage 220*d* may use the same groups as the level analysis stages 220*a*, the correlation analysis stage 220*b* or the dynamic panning detection stage 220*c* or different groups provided by grouper/aligner 210.

The weighting stage 235, for example, may average contributions to the measure of spatiality to obtain the measure of spatiality. The contributions may be based on a combination of the factors 220*a*', 220*b*', 220*c*' and/or 220*d*'. The averaging may be uniform or weighted, wherein a weighting may be performed based on a significance of a factor.

In some embodiments the measure of spatiality can be obtained based on only one or more of the analysis stages 220*a-c*. Further, the grouper/aligner may be integrated in any one of the analysis stages 220*a-c*, e.g. such that each analysis stage performs a grouping on its own.

Figure 3:
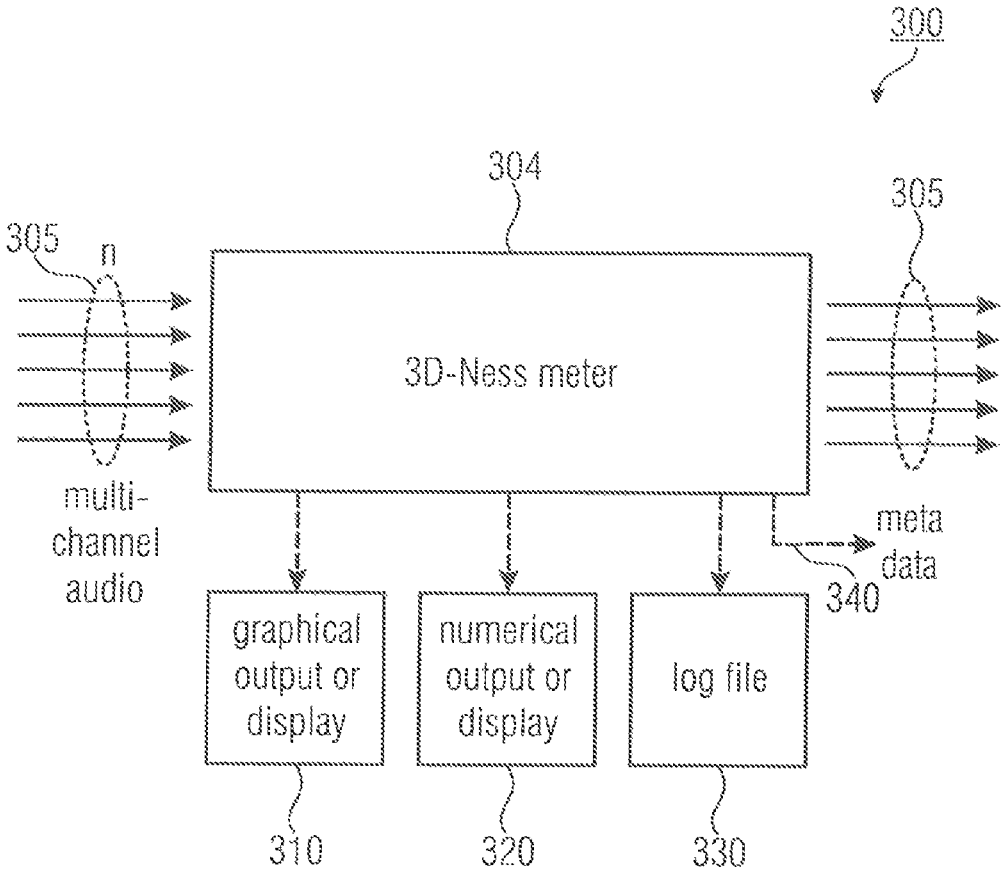
FIG. 3 shows a block diagram of an apparatus according to embodiments of the invention.

FIG. 3 shows a block diagram of an apparatus 300 according to embodiments of the invention. In other words, FIG. 3 shows a general signal flow for a 3D-Ness meter 304. The apparatus 300 is comparable to the apparatuses 100 and 200 and takes as input a multichannel audio signal 305, which it may also output unchanged. The 3D-Ness meter 304 is an evaluator according to evaluator 110 and evaluator 204. Based on the multichannel audio signal 305, the measure of spatiality may be output graphically using a graphic output or display 310 (e.g., a graph), using a numerical output or display 320 (e.g., using one numerical scalar value for an entire audio stream) and/or using a log file 330 in which, for example, the graph or the scalar may be written. Further, the apparatus 300 may provide additional metadata 340 which may be included into the audio signals 305 or an audio stream including the audio signals 305, wherein the metadata may comprise the measure of spatiality. Furthermore, the additional metadata may comprise the upmix origin estimate or any of the outputs of the analysis stages in apparatus 200.

FIG. 4 shows a 3D-audio loudspeaker set up 400. In other words, FIG. 4 illustrates a 3D-audio reproduction layout in a 5+4 configuration. The middle layer loudspeakers are indicated with the letter M and upper layer loudspeakers are labeled U. The number refers to the azimuth of a speaker with regard to a listener (e.g., M30 is a loudspeaker located in the middle layer at 30° degree azimuth). The loudspeaker set up 400 may be used by assigning audio channels from an audio stream (e.g., stream 105, audio channels 106, 206 or 305) to reproduce the audio stream. The loudspeaker set up comprises a first layer of loudspeakers 410 and second layer of loudspeakers 420 which is arranged vertically distanced from the first layer of loudspeakers 410. The first layer of loudspeakers comprises five loudspeakers, i.e., center M0, front-right M-30, front-left M30, surround-right M-110 and surround-left M110. Further, the second layer of loudspeakers 420 comprises four loudspeakers, i.e., upper left U30, upper right U-30, upper rear-right U-110 and upper rear-left U110. For analysis using the apparatuses 100, 200 or 300, groupings may be provided based on the layers, i.e., layer 410 and layer 420. Moreover, groups may be formed across layers, e.g., using loudspeakers on the left from a listener to form a first group and loudspeakers on the right from a listener to obtain a second group. Alternatively, a first group may be based on loudspeakers located in front of a listener and a second group may be based on loudspeaker located at the back of a listener, wherein the first group or the second group comprise loudspeakers which are vertically distanced, i.e. the groups may be formed having vertical layers. Moreover, further arbitrary groupings are definable and loudspeaker setups can be considered.

Figure 5:
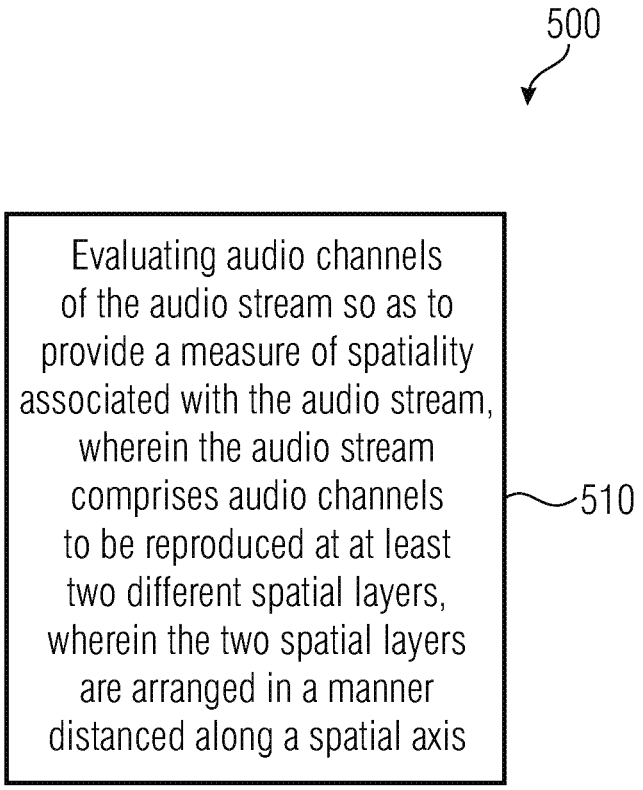
FIG. 5 shows a flow chart of a method according to embodiments of the invention.

FIG. 5 shows a flow chart of a method 500 according to embodiments of the invention. The method comprises evaluating 510 audio channels of the audio stream so as to provide a measure of spatiality associated with the audio stream. Further, audio stream comprises audio channels to be reproduced at at least two different spatial layers, wherein the two spatial layers are arranged in a manner distanced along a spatial axis.

In the following, further details with reference to FIG. 2 are provided:

Embodiments describe a method for measuring the power (or intensity) of a 3D-audio effect for a given 3D-audio signal. It has been found that looking at 3D-audio content, finding sections in the material that feature 3D effects and evaluating their power was a subjective task that needed to be done by hand. Embodiments describe a 3D-Ness meter that can be used to support this process and may accelerate it by indicating, at what time position 3D effects occur, and by assessing strength of the 3D effects.

The term '3D-Ness' has not been used so far for the strength of 3D-audio effects in the academic field, because it covers a very broad range of meanings. Therefore, more precise terms and definitions have been elaborated [9, 10]. These terms only apply to one specific aspect of the reproduced audio, not the entire impression. For general impression, the terms over-all listening experience (OLE) or quality of experience (QoE) have been introduced [11]. The latter terms are not limited to 3D-audio. To separate the 3D-audio effect strength from terms like OLE and QoE, the term 3D-Ness is used sometimes in this document.

In general, a reproduction system can be called 3D-audio or 'immersive' if it is capable of producing sound sources in at least two different vertical layers (see FIG. 4). Common 3D-audio reproduction layouts are 5.1+4, 7.1+4 or 22.2 [12].

Effects which are specific for 3D-audio are:

Perception of elevated sound sources

Localization accuracy (azimuth, elevation, distance) [9]

Dynamic localization accuracy (for moving objects) [9]

Engulfment (the sense of being covered over by sound) [13, 14, 15]

Spatial clarity (how clearly you are able to perceive the spatial scene) [14, 15]

These effects are referred to as quality features [9] or categories for attributes [10, 16] for 3D-audio. Note, that the power of 3D-audio effects does not directly correlate to the OLE or the QoE.

To give practical examples of 3D-Ness, some scenarios are listed:

- A sound source moves across different vertical layers, e.g., a whoosh sound effect moves from the middle (or horizontal) layer to the upper layer.
- Sound sources are reproduced by the middle and upper layer, e.g., the main sound is perceived on the middle layer and a voice sets in talking from above or direct sound is reproduced by the middle layer and ambient sound is reproduced by the upper layer.

Furthermore, on the production side, a demand of measuring 3D-Ness can be found at film sound mixing facilities where the sound track is finalized. When the content is prepared to be distributed on Blu-ray or streaming services, 3D-Ness monitoring is of interest, as well. Content distributors, such as broadcast stations, over the top (OTT) streaming and download services [17] need to measure 3D-Ness to be able to decide which content to promote as 3D-audio highlight program. Research, educational institutions and film critique are other entities that have interest in measuring 3D-Ness for different reasons.

Conventional methods are not suitable for measuring the 3D-Ness of a 3D-audio signal. Therefore, a 3D-Ness meter has been proposed herein. Generally, a multichannel audio signal is fed into the meter where audio analysis happens (see FIG. 3). An output may be an unprocessed and unchanged audio content along with 3D-Ness measures in various representations. The 3D-Ness meter can display the 3D-Ness as a function of time graphically. Alternatively, it can express its measurements numerically and compute statistics to make different materials comparable. All results may also be exported to a log file or can be added to the original audio (stream) in a suitable metadata format. For audio in an object based or scene based, e.g. first order ambisonics (FOA) or higher order ambisonics (HOA), form of representation, audio channels can be assessed by rendering to a reference speaker layout first.

In embodiments, an operation mode of the 3D-Ness meter is shared across different, in parallel working, analysis stages. Each stage may detect characteristics of the audio signal that is specific for certain 3D-audio effects (see FIG. 2). The results of the analysis stages may be weighted, summed up and displayed. Finally, on a display a sound engineer may be provided with a total 3D-Ness indicator (e.g., the measure of spatiality) and some of the most significant sub results (e.g., the results of the individual analysis stages). Thereby, a sound engineer has various data that may support him in finding sections of interest or making decisions about the 3D-Ness. A total 3D-Ness indicator can be on a linear scale, having a range from zero to two (0 . . . 2), wherein a 3D-Ness=0 means that there is no, or no significant, 3D-audio effect at all to expect in the evaluated audio stream. A maximum value of 3D-Ness=2 may indicate very strong 3D-audio effects to occur in the audio stream. The range as well as units of the total 3D-Ness indicator scale may be predetermined and could use other values, units or ranges (e.g., −1 . . . 1, 0 . . . 10, etc.).

In a step, input channels may be assigned to specific channel pairs or channel groups. Possible channel pairs include, but are not limited to:

- Middle layer left and upper layer left
- Middle layer left surround and upper layer left surround
- Middle layer center and upper layer left.

Possible channel groupings included, but are not limited to:

- Middle layer and upper layer
- Middle layer left and right and upper layer left and right.

In the following, parameters which may be used and/or determined in embodiments are described. Furthermore, in the following groupings of channels by layers is primarily considered, however, other groupings may be used in other embodiments.

Level Analysis Stage

A level analysis stage 220*a* may monitor if there is level in an upper layer at all and if so, how high it is in relation to a middle layer. An important measure may be a masking threshold for vertical sound sources [18, 19]. This analysis stage may only detect 3D-Ness, when the masking threshold of a middle layer signal is significantly exceed by the upper layer or vice versa. When there is no signal (or level) measured in the upper layer or when the level is too low in relation to the corresponding middle layer signal at that time, a 3D-Ness meter may report a low 3D-Ness value (e.g., based on information obtained from the level analysis stage).

In embodiments, a 3D-Ness meter can be set up (i) to compare the level of the upper layer to the masking threshold of the middle layer, (ii) to compare the middle layer level to the upper layer masking threshold or (iii) to compare all given layer and to examine the level of the lower level layer (e.g. layer having the lowest level) to the corresponding other layers.

Correlation Stage

In embodiments, a correlation stage 220*b* is used to analyze channel pairs or channel groups for their normalized short-term cross correlation. This measure expresses how similar two signals are and may be derived from a difference in energy over time. A very high similarity of the upper layer signal indicates that most likely elements of the middle layer signal, or the entire middle layer signal, is also fed into the upper layer. This may produce a certain perceived envelopment or a slightly upwards moved sound scene.

A low correlation indicates that the signals in the middle and upper layer are not similar, which would result into stronger 3D-audio effects. The correlation stage and the level analysis stage may exchange information (see dotted lines in FIG. 2). When the level of the upper layer, for example, is only close to or slightly above the masking threshold, an indicated 3D-Ness may be low when the correlation stage signals a high degree of correlation. However, if for the same level relation the correlation is low instead, an indicated 3D-Ness may be higher.

Dynamic Panning Detection

In embodiments, a panning detection stage 220*c* looks for sound elements that appear at different times at different positions. Dynamic panning is characterized by a signal that may move through space, such as a helicopter flying from the middle layer front left position to the upper layer rear right position. Signal-wise a panning movement results in cross fades from one channel or group of channels to another. If such cross fades are detected within the signals, a panning effect is likely to produce a 3D-audio effect (e.g., a high perceived spatiality). Level information from the level analysis stage may be processed in more detail and with other time constants (e.g., resulting in longer averaging windows).

Upmix Estimation

Upmixing algorithms are well established in sound processing. Usually, they may use decorrelation and signal separation to increase the number of used channels for a wider, more enveloping and more exciting sound reproduction.

An upmix detection stage 220*d* examines if a given decorrelation can be a result of a previously applied automatic upmix. Therefore, the data of a correlation stage (e.g., 220*a*) are used. In addition, the signals may be analyzed to find artefacts and results that may be originated from the most common upmix methods.

Whether hints for an automatic upmix can be found may be an important information because possible following downmixes may cause sound coloration. Furthermore, an automatic upmix could be considered less valuable compared to an artistically created 3D-audio mix. Therefore, a low spatiality may be indicated from an obtained measure of spatiality, if it has been estimated that the audio stream is based on an upmix.

Further Applications

In order to illustrate the usefulness of embodiments of the invention, some practical use cases of a 3D-Ness meter are presented.

Scenario 1:

A sound engineer is asked to tell if a given movie mix contains 3D-audio or not. Without a 3D-Ness meter, the engineer needs to listen to the entire sound track to see if any relevant 3D-effects occur. With a 3D-Ness meter, the audio can be analyzed offline—which means much faster than real-time—and sections in which 3D effects occur are marked. By looking at the results, an engineer can tell if the material contains 3D-audio effects.

Scenario 2:

An engineer is asked to find the most impressing 3D-audio sections of a movie sound track. By looking at the results of the 3D-Ness meter it is much faster to identify spots with 3D effects. Only sections that have been pointed out by the 3D-Ness meter need to be listened to.

Scenario 3:

A production company needs to decide, which one of two possible titles should be released for Blu-ray with an additional 3D-audio track. The results of the 3D-Ness meter indicate which title makes use of 3D-audio effects more often and can be a basis for economic decisions.

Scenario 4:

A 3D-audio production is mixed. The 3D-Ness meter can monitor the signal and indicate to the mixing engineer, when a desired 3D effect is very strong and thus may be distracting. Or the engineer wants to create a 3D effect and the 3D-Ness meter indicates, that the effect is not strong enough to be perceived easily.

Scenario 5:

A 3D-audio mix was delivered and the client wants to examine, if the mix was created by an engineer with artistic intent or if it is only an automatic upmix. The 3D-Ness meter may give indications, if automatic upmixing has been applied.

In embodiments, the concept of the 3D-Ness meter not only includes the graphical or numerical representation of the measured parameters but the entire process of determining the existence and amount of auditory 3D-effects in 3D audio signals.

Furthermore, the method of the 3D-Ness meter can also be used for non-3D-audio content or 2D multichannel surround content to indicate how much surround effects are expected and at what time of the program they are located. For this, instead of comparing two vertically spaced channels or groups of channels, horizontally spaced channels or groups of channels may be compared, e.g. front channels and surround channels.

Although some aspects have been described in the context of an apparatus, it is clear that these aspects also represent a description of the corresponding method, where a block or device corresponds to a method step or a feature of a method step. Analogously, aspects described in the context of a method step also represent a description of a corresponding block or item or feature of a corresponding apparatus. Some or all of the method steps may be executed by (or using) a hardware apparatus, like for example, a microprocessor, a programmable computer or an electronic circuit. In some embodiments, one or more of the most important method steps may be executed by such an apparatus.

Depending on certain implementation requirements, embodiments of the invention can be implemented in hardware or in software. The implementation can be performed using a digital storage medium, for example a floppy disk, a DVD, a Blu-Ray, a CD, a ROM, a PROM, an EPROM, an EEPROM or a FLASH memory, having electronically readable control signals stored thereon, which cooperate (or are capable of cooperating) with a programmable computer system such that the respective method is performed. Therefore, the digital storage medium may be computer readable.

Some embodiments according to the invention comprise a data carrier having electronically readable control signals, which are capable of cooperating with a programmable computer system, such that one of the methods described herein is performed.

Generally, embodiments of the present invention can be implemented as a computer program product with a program code, the program code being operative for performing one of the methods when the computer program product runs on a computer. The program code may for example be stored on a machine readable carrier.

Other embodiments comprise the computer program for performing one of the methods described herein, stored on a machine readable carrier.

In other words, an embodiment of the inventive method is, therefore, a computer program having a program code for performing one of the methods described herein, when the computer program runs on a computer.

A further embodiment of the inventive methods is, therefore, a data carrier (or a digital storage medium, or a computer-readable medium) comprising, recorded thereon, the computer program for performing one of the methods described herein. The data carrier, the digital storage medium or the recorded medium are typically tangible and/or non-transitionary.

A further embodiment of the inventive method is, therefore, a data stream or a sequence of signals representing the computer program for performing one of the methods described herein. The data stream or the sequence of signals may for example be configured to be transferred via a data communication connection, for example via the Internet.

A further embodiment comprises a processing means, for example a computer, or a programmable logic device, configured to or adapted to perform one of the methods described herein.

A further embodiment comprises a computer having installed thereon the computer program for performing one of the methods described herein.

A further embodiment according to the invention comprises an apparatus or a system configured to transfer (for example, electronically or optically) a computer program for performing one of the methods described herein to a receiver. The receiver may, for example, be a computer, a mobile device, a memory device or the like. The apparatus or system may, for example, comprise a file server for transferring the computer program to the receiver.

In some embodiments, a programmable logic device (for example a field programmable gate array) may be used to perform some or all of the functionalities of the methods described herein. In some embodiments, a field programmable gate array may cooperate with a microprocessor in order to perform one of the methods described herein. Generally, the methods are performed by any hardware apparatus.

The apparatus described herein may be implemented using a hardware apparatus, or using a computer, or using a combination of a hardware apparatus and a computer.

The apparatus described herein, or any components of the apparatus described herein, may be implemented at least partially in hardware and/or in software.

The methods described herein may be performed using a hardware apparatus, or using a computer, or using a combination of a hardware apparatus and a computer.

The methods described herein, or any components of the apparatus described herein, may be performed at least partially by hardware and/or by software.

While this invention has been described in terms of several advantageous embodiments, there are alterations, permutations, and equivalents which fall within the scope of this invention. It should also be noted that there are many alternative ways of implementing the methods and compositions of the present invention. It is therefore intended that the following appended claims be interpreted as including all such alterations, permutations, and equivalents as fall within the true spirit and scope of the present invention.

REFERENCES

[1] EBU. EBU TECH 3344: Practical guidelines for distribution systems in accordance with EBU R 128. Geneva, 2011.

[2] IRT. Technische Richtlinien—HDTV. Zur Herstellung von Fernsehproduktionen für ARD, ZDF and ORF. Frankfurt a.M., 2011.

[3] ARTE. Allgemeine technische Richtlinien. ARTE, Kehl, 2013.

[4] Gerhard Spikofski and Siegfried Klar. Levelling and Loudness in Radio and Television Broadcasting. European Broadcast Union, Geneva, 2004.

[5] ITU. ITU-R BS.2054-2: Audio Levels and Loudness, volume 2. International Telecommunication Union, Geneva, 2011.

[6] Robin Gareus and Chris Goddard. Audio Signal Visualisation and Measurement. In International Computer Music and Sound & Music Computing Conference, Athens, 2014.

[7] B Mendiburu. 3D Movie Making—Stereoscopic Digital Cinema from Script to Screen. Focal Press, 2009.

[8] B. Mendiburu. 3D TV and 3D Cinema. Tools and Processes for Creative Stereoscopy. Focal Press, 2011.

[9] Andreas Silzle. 3D Audio Quality Evaluation: Theory and Practice. In International Conference on Spatial Audio, Erlangen, 2014. VDT.

[10] Nick Zacharov and Torben Holm Pedersen. Spatial sound attributes—development of a common lexicon. In AES 139th Convention, New York, 2015. Audio Engineering Society.

[11] Michael Schoeffler, Sarah Conrad, and Jürgen Herre. The Inuence of the Single/Multi-Channel-System on the Overall Listening Experience. In AES 55th Conference, Helsinki, 2014.

[12] Ulli Scuda. Comparison of Multichannel Surround Speaker Setups in 2D and 3D. In Malte Kob, editor, International Conference on Spatial Audio, Erlangen, 2014. VDT.

[13] R Sazdov, G Paine, and K Stevens. Perceptual Investigation into Envelopment, Spatial Clarity and Engulfment in Reproduced Multi-Channel Audio. In AES 31st Conference, London, 2007. Audio Engineering Society.

[14] R Sazdov. The effect of elevated loudspeakers on the perception of engulfment, and the effect of horizontal loudspeakers on the perception of envelopment. In ICSA 2011. VDT.

[15] Robert Sazdov. Envelopment vs. Engulfment: Multidimensional scaling on the effect of spectral content and spatial dimension within a three-dimensional loudspeaker setup. In International Conference on Spatial Audio, Graz, 2015. VdT.

[16] Torben Holm Pedersen and Nick Zacharov. The development of a Sound Wheel for Reproduced Sound. In AES 138th Convention, Warsaw, 2015. AES.

[17] AES. Technical Document AESTD1005.1.16-09: Audio Guidelines for Over the Top Television and Video Streaming. AES, New York, 2016.

[18] Hyunkook Lee. The Relationship between Interchannel Time and Level Differences in Vertical Sound Localisation and Masking. In AES 131st Convention, number IcId, pages 1-13, 2011.

[19] Hanne Stenzel, Ulli Scuda, and Hyunkook Lee. Localization and Masking Thresholds of Diagonally Positioned Sound Sources and Their Relationship to Interchannel Time and Level Differences. In International Conference on Spatial Audio, Erlangen, 2014. VDT.

The invention claimed is:

1. An apparatus for evaluating an audio stream, wherein the audio stream comprises audio channels to be reproduced at at least two different spatial layers, wherein the two spatial layers are arranged in a manner distanced along a spatial axis, wherein the apparatus comprises a computer programmed to, or an electronic circuit configured to, evaluate the audio channels of the audio stream to provide a measure of spatiality associated with the audio stream, by acquiring an upmix origin estimate based on a similarity measure between a first set of audio channels of the audio stream and a second set of audio channels of the audio stream, the upmix origin estimate indicating whether the audio stream has been obtained by upmixing, and determining the measure of spatiality based on the upmix origin estimate.

2. An apparatus according to claim 1, wherein the spatial axis is oriented horizontally, or wherein the spatial axis is oriented vertically.

3. An apparatus according to claim 1, wherein the apparatus is configured to acquire a first level information based on a first set of audio channels of the audio stream and to acquire a second level information based on a second set of audio channels of the audio stream, and wherein the apparatus is configured to determine a spatial level information based on the first level information and the second level information and to determine the measure of spatiality based on the spatial level information.

4. An apparatus according to claim 3, wherein the first set of audio channels of the audio stream is disjoint to the second set of audio channels of the audio stream.

5. An apparatus according to claim 3, wherein the first set of audio channels of the audio stream is to be reproduced on loudspeakers in one or more first spatial layers and wherein the second set of audio channels of the audio stream is to be reproduced on loudspeakers on one or more second spatial layers, wherein the one or more first layers and the one or more second layers are spatially distanced.

6. An apparatus according to claim 1, wherein the apparatus is configured to decrease the measure of spatiality based on the upmix origin estimate when the upmix origin estimate indicates that the audio channels of the audio stream are derived from an audio stream with fewer audio channels.

7. An apparatus according to claim 1, wherein the apparatus is configured to output the measure of spatiality accompanied with the upmix origin estimate.

8. An apparatus according to claim 1, wherein the apparatus is configured to provide the measure of spatiality based on a weighting of at least two of the following parameters:

a spatial level information of the audio stream, and/or a similarity measure of the audio stream, and/or a panning information of the audio stream, and/or an upmix origin estimate of the audio stream.

9. An apparatus according to claim 1, wherein the apparatus is configured to visually output the measure of spatiality.

10. An apparatus for evaluating an audio stream, wherein the audio stream comprises audio channels to be reproduced at at least two different spatial layers, wherein the two spatial layers are arranged in a manner distanced along a spatial axis, wherein the apparatus comprises a computer programmed to, or an electronic circuit configured to, evaluate the audio channels of the audio stream to provide a measure of spatiality associated with the audio stream by:

acquiring a first level information based on a first set of audio channels of the audio stream and acquiring a second level information based on a second set of audio channels of the audio stream, and determining the measure of spatiality based on the first level information and the second level information, wherein the first set of audio channels of the audio stream is to be reproduced on loudspeakers in one or more first spatial layers and wherein the second set of audio channels of the audio stream is to be reproduced on loudspeakers on one or more second spatial layers, wherein the one or more first layers and the one or more second layers are spatially distanced, wherein the apparatus is configured to determine a masking threshold based on a level information of the first set of audio channels and to compare the masking threshold to a level information of the second set of audio channels, and wherein the apparatus is configured to increase the measure of spatiality when the comparison indicates that the masking threshold is exceeded by the sound level of the second set of audio channels.

11. An apparatus according to claim 10, wherein the apparatus is configured to determine a similarity measure between a first set of audio channels of the audio stream to be reproduced at one or more first spatial layers and a second set of audio channels of the audio stream to be reproduced at one or more second spatial layers, and to determine the measure of spatiality based on the similarity measure.

12. An apparatus for evaluating an audio stream, wherein the audio stream comprises audio channels to be reproduced at at least two different spatial layers, wherein the two spatial layers are arranged in a manner distanced along a spatial axis, wherein the apparatus comprises a computer programmed to, or an electronic circuit configured to, evaluate the audio channels of the audio stream to provide a measure of spatiality associated with the audio stream, by:

determining a similarity measure between a first set of audio channels of the audio stream to be reproduced at one or more first spatial layers and a second set of audio channels of the audio stream to be reproduced at one or more second spatial layers, determining the measure of spatiality based on the similarity measure, determining a masking threshold based on a level information of the first set of audio channels and to compare the masking threshold to a level information of the second set of audio channels, and increasing the measure of spatiality when the comparison indicates that the masking threshold is exceeded by the level information of the second set of audio channels and the similarity measure indicates a low similarity between the first set and the second set.

13. An apparatus according to claim 12, wherein the apparatus is configured to analyze the audio channels of the audio stream with respect to a temporal variation of a panning of a sound source onto the audio channels.

14. An apparatus according to claim 12, wherein the apparatus is configured to determine the measure of spatiality such that the lower the similarity measure the larger the measure of spatiality.

15. An apparatus for evaluating an audio stream, wherein the audio stream comprises audio channels to be reproduced at at least two different spatial layers, wherein the two spatial layers are arranged in a manner distanced along a spatial axis, wherein the apparatus comprises a computer programmed to, or an electronic circuit, configured to:

evaluate the audio channels of the audio stream to provide a measure of spatiality associated with the audio stream, and visually output the measure of spatiality, and provide the measure of spatiality as a graph, wherein the graph is configured to provide an information on the measure of spatiality over time, wherein a time axis of the graph is aligned to the audio stream.

16. An apparatus for evaluating an audio stream, wherein the audio stream comprises audio channels to be reproduced at at least two different spatial layers, wherein the two spatial layers are arranged in a manner distanced along a spatial axis, wherein the apparatus comprises a computer programmed to, or an electronic circuit, configured to:

evaluate the audio channels of the audio stream to provide a measure of spatiality associated with the audio stream, and provide the measure of spatiality as a numerical value, wherein the numerical value represents the entire audio stream.

17. An apparatus according to claim 16, wherein the apparatus is configured to write the measure of spatiality into a log file.

18. A method for evaluating an audio stream, wherein the audio stream comprises audio channels to be reproduced at at least two different spatial layers, wherein the two spatial layers are arranged in a manner distanced along a spatial axis, the method comprising:

evaluating audio channels of the audio stream to provide a measure of spatiality associated with the audio stream by:

acquiring a first level information based on a first set of audio channels of the audio stream and acquiring a second level information based on a second set of audio channels of the audio stream, and determining the measure of spatiality based on the first level information and the second level information, wherein the first set of audio channels of the audio stream is to be reproduced on loudspeakers in one or more first spatial layers and wherein the second set of audio channels of the audio stream is to be reproduced on loudspeakers on one or more second spatial layers, wherein the one or more first layers and the one or more second layers are spatially distanced, determining a masking threshold based on a level information of the first set of audio channels and to compare the masking threshold to a level information of the second set of audio channels, and increasing the measure of spatiality when the comparison indicates that the masking threshold is exceeded by the sound level of the second set of audio channels.

19. A method for evaluating an audio stream, wherein the audio stream comprises audio channels to be reproduced at at least two different spatial layers, wherein the two spatial layers are arranged in a manner distanced along a spatial axis, the method comprising:

evaluating audio channels of the audio stream to provide a measure of spatiality associated with the audio stream;

visually outputting the measure of spatiality, and providing the measure of spatiality as a graph, wherein the graph is configured to provide an information on the measure of spatiality over time, wherein a time axis of the graph is aligned to the audio stream.

20. Method for evaluating an audio stream, wherein the audio stream comprises audio channels to be reproduced at at least two different spatial layers, wherein the two spatial layers are arranged in a manner distanced along a spatial axis, the method comprising:

evaluating audio channels of the audio stream to provide a measure of spatiality associated with the audio stream; and providing the measure of spatiality as a numerical value, wherein the numerical value represents the entire audio stream.

21. Method for evaluating an audio stream, wherein the audio stream comprises audio channels to be reproduced at at least two different spatial layers, wherein the two spatial layers are arranged in a manner distanced along a spatial axis, the method comprising:

evaluating audio channels of the audio stream to provide a measure of spatiality associated with the audio stream by:

determining a similarity measure between a first set of audio channels of the audio stream to be reproduced at one or more first spatial layers and a second set of audio channels of the audio stream to be reproduced at one or more second spatial layers, and determining the measure of spatiality based on the similarity measure, and determining a masking threshold based on a level information of the first set of audio channels and to compare the masking threshold to a level information of the second set of audio channels, and increasing the measure of spatiality when the comparison indicates that the masking threshold is exceeded by the level information of the second set of audio channels and the similarity measure indicates a low similarity between the first set and the second set.

22. Method for evaluating an audio stream, wherein the audio stream comprises audio channels to be reproduced at at least two different spatial layers, wherein the two spatial layers are arranged in a manner distanced along a spatial axis, the method comprising:

evaluating audio channels of the audio stream to provide a measure of spatiality associated with the audio stream by:

acquiring an upmix origin estimate based on a similarity measure between a first set of audio channels of the audio stream and a second set of audio channels of the audio stream, the upmix origin estimate indicating whether the audio stream has been obtained by upmixing, and determining the measure of spatiality based on the upmix origin estimate.

23. A non-transitory digital storage medium having a computer program, to be executed by a computer, stored thereon to perform the method for evaluating an audio stream, wherein the audio stream comprises audio channels to be reproduced at at least two different spatial layers, wherein the two spatial layers are arranged in a manner distanced along a spatial axis, the method comprising:

evaluating audio channels of the audio stream to provide a measure of spatiality associated with the audio stream by:

determining a similarity measure between a first set of audio channels of the audio stream to be reproduced at one or more first spatial layers and a second set of audio channels of the audio stream to be reproduced at one or more second spatial layers;

acquiring an upmix origin estimate based on a similarity measure between a first set of audio channels of the audio stream and a second set of audio channels of the audio stream, the upmix origin estimate indicating whether the audio stream has been obtained by upmixing, and determining the measure of spatiality based on the upmix origin estimate.

24. A non-transitory digital storage medium having a computer program stored thereon to perform the method for evaluating an audio stream, wherein the audio stream comprises audio channels to be reproduced at at least two different spatial layers, wherein the two spatial layers are arranged in a manner distanced along a spatial axis, the method comprising:

evaluating audio channels of the audio stream to provide a measure of spatiality associated with the audio stream by:

determining a similarity measure between a first set of audio channels of the audio stream to be reproduced at one or more first spatial layers and a second set of audio channels of the audio stream to be reproduced at one or more second spatial layers, determining the measure of spatiality based on the similarity measure, determining a masking threshold based on a level information of the first set of audio channels and to compare the masking threshold to a level information of the second set of audio channels, and increasing the measure of spatiality when the comparison indicates that the masking threshold is exceeded by the level information of the second set of audio channels and the similarity measure indicates a low similarity between the first set and the second set, when said computer program is run by a computer.

* * * * *